US006808212B1

(12) United States Patent
Hardee

(10) Patent No.: US 6,808,212 B1
(45) Date of Patent: Oct. 26, 2004

(54) REVERSIBLE SECURITY GATE LATCH

(76) Inventor: Carl B. Hardee, 2271 Highway 348, Loris, SC (US) 29569

( * ) Notice: Subject to any disclaimer, the term of this patent is extended or adjusted under 35 U.S.C. 154(b) by 0 days.

(21) Appl. No.: 10/428,511

(22) Filed: May 2, 2003

(51) Int. Cl.[7] ..... E05C 1/04
(52) U.S. Cl. ..... 292/150; 292/244; 292/341.15
(58) Field of Search ..... 292/137, 162, 292/164, 145, 147, 150, 151, 341.15, 244

(56) References Cited

U.S. PATENT DOCUMENTS

| | | | | | |
|---|---|---|---|---|---|
| 258,833 | A | * | 5/1882 | White | 70/429 |
| 668,108 | A | | 2/1901 | Mailloux | |
| 873,185 | A | | 12/1907 | Stratton | |
| 891,667 | A | | 6/1908 | Browning | |
| 1,317,092 | A | | 9/1919 | Maurer et al. | |
| 1,326,554 | A | | 12/1919 | Watson | |
| 1,374,878 | A | * | 4/1921 | Childers | 292/150 |
| 1,728,747 | A | | 9/1929 | Chesher | |
| 2,794,663 | A | * | 6/1957 | Grodt et al. | 292/67 |
| 2,912,845 | A | * | 11/1959 | Mordovanecy | 70/125 |
| 3,697,106 | A | | 10/1972 | Meyer | |
| 3,877,738 | A | | 4/1975 | Nelson | |
| 3,907,344 | A | | 9/1975 | Newlon et al. | |
| 3,907,345 | A | | 9/1975 | Martini | |
| 3,936,083 | A | * | 2/1976 | Bright | 292/149 |
| 4,014,192 | A | | 3/1977 | Dillon et al. | |
| 4,062,575 | A | * | 12/1977 | Robins | 292/67 |
| 4,341,408 | A | * | 7/1982 | Blevins | 292/150 |
| 4,643,469 | A | * | 2/1987 | Johnston et al. | 292/66 |
| 4,889,372 | A | | 12/1989 | Dege et al. | |
| 5,243,325 | A | | 9/1993 | Marin et al. | |
| 5,489,129 | A | | 2/1996 | Shepherd | |
| 5,511,835 | A | | 4/1996 | Hardee | |
| 5,586,793 | A | | 12/1996 | Davenport | |
| 5,738,389 | A | | 4/1998 | Marks | |
| 5,782,507 | A | | 7/1998 | Hardee | |
| 5,799,990 | A | | 9/1998 | Hardee | |
| 6,192,629 | B1 | | 2/2001 | Akins et al. | |

FOREIGN PATENT DOCUMENTS

| | | |
|---|---|---|
| GB | 231626 | 4/1925 |
| GB | 412000 | 6/1934 |
| GB | 792777 | 4/1958 |

* cited by examiner

*Primary Examiner*—Gary Estremsky
(74) *Attorney, Agent, or Firm*—Harleston Law Firm LLC; Kathleen M. Harleston

(57) ABSTRACT

A security latch for a double gate or door includes:

a. a striker unit for attachment to a first side of the gate or door, including: 1) a striker with at least two notches at its top, a first notch being proximate to a horizontal center of the striker, a second notch being proximate to a right end of the striker; 2) a security plate adjacent to the striker; 3) a striker bracket attached to the security plate and through which the striker slides; and 4) a locking member slidably attached to the security plate, the striker being slidable through the locking member, a portion of the locking member being slidable into at least one of the notches;

b. a separate keeper unit for attachment to an opposite, second side of the gate or door, including: 1) two matching C-brackets for receiving the striker, and 2) a keeper plate, each C-bracket being attached to the keeper plate; and c. a gate attaching mechanism for securing the security plate of the striker unit and the keeper plate of the keeper unit to the respective side of the gate or door. A separate C-bracket keeper unit is also included for single hung doors or gates.

17 Claims, 9 Drawing Sheets

REVERSIBLE SECURITY GATE LATCH

BACKGROUND OF THE INVENTION

1. Field of the Invention

The present invention relates to the field of gate and door latches and, more particularly, to a gate and door latch that is attachable on either side of a single or double hung door or gate and, thus, reversible, the gate or door latch being constructed so as to provide security by making detachment difficult.

2. Background Information

The field of door and gate latches is an area of invention that has existed as long as the need to secure gates and doors has existed. Although the primary purpose served by a latch can be met by perhaps the most basic and simple design, more complex and improved latch designs are desirable. The typical latch design requires a latching means provided in a closed door or gate position and simple unlatching means for the opening of a door or gate. The typical means by which the door or gate is opened is accomplished by a handle means, which is turned, pushed, pulled or otherwise manipulated to effect the unlatching of the latch device.

The striker of the latch of the present invention can be easily used in both a left-handed and a right-handed configuration, such that the latch may be used on either the inside or the outside of a gate or door. Preferably, one of the inventive latches will be placed on the inside of the door or gate, and one will be placed on the outside of the door or gate for improved security. The outside latch may be locked open and cannot be used to lock the gate or door when the user is inside the paddock, room, etc. accessed by the gate or door. Similarly, the inside latch may be locked open and cannot be used when the user is outside the gate or door.

The present invention provides a gate and door latch usable in both a left-hand and right-hand configuration. The gate and door latch of the present invention may be attached in such a manner that when the striker is in place, the screws, bolts, or other means of attaching the latch to the gate or door are covered and thus cannot be removed. This enhances the security it provides. The present invention provides a latch with security taps, which also discourages burglary. For added convenience and safety, the latch of the present invention may also be locked in an open or closed position.

SUMMARY OF THE INVENTION

The present invention is a reversible security latch for a double gate or door, including:

a. a striker unit for attachment to a first side of the gate or door, comprising:
   1) a striker into its top being defined at least two notches, a first one of the notches being proximate to a horizontal center of the striker, a second one of the notches being proximate to a right end of the striker when viewed from the front;
   2) a security plate, which lies adjacent to the striker;
   3) a striker bracket attached to the security plate and through which the striker slides;
   4) a locking member slidably attached to the security plate, the striker being slidable through the locking member, a portion of the locking member being slidable into at least one of the notches for fastening the striker or preventing the striker from sliding; and b. a separate keeper unit for attachment to an opposite, second side of the gate or door, comprising:

1) two matching C-brackets for receiving the striker,
   2) a keeper plate, each C-bracket being attached to the keeper plate; and c. a gate attaching means for securing the security plate of the striker unit and the keeper plate of the keeper unit to the respective side of the double gate or door. The striker unit preferably further includes a generally vertically oriented striker handle attached to the generally horizontally oriented striker adjacent to the first notch.

An alternate embodiment of a reversible security latch for a double gate or door includes:

a. a striker unit for attachment to a first side of the double gate or door, comprising:
   1) a striker into its top being defined at least one notch proximate to a horizontal center of the striker;
   2) a security plate, which lies adjacent to the striker;
   3) a striker bracket attached to the security plate and through which the striker slides;
   4) a locking member slidably attached to the security plate through which the striker slides;
   5) an upper bracket and a lower bracket attaching the locking member to the security plate; and b. a separate handle unit for attachment to a side of the double gate or door, comprising: a handle grip and a substantially planar handle base, the handle grip being attached at substantially a ninety degree angle to a front surface of the handle base, a handle space being defined within the handle grip, the handle grip and the handle base defining a striker space, the striker being slidable through the striker space; and c. a gate attaching means for securing the security plate of the striker unit and a base of the handle unit to the respective side of the double gate or door.

Also included herein is a security latch for a single door or gate comprising a striker unit and a keeper unit with a C-bracket defining a keeper space for receiving a striker.

BRIEF DESCRIPTION OF THE DRAWINGS

A preferred embodiment of the present invention is described herein with reference to the drawings wherein.

DETAILED DESCRIPTION OF THE INVENTION

Figure 1:
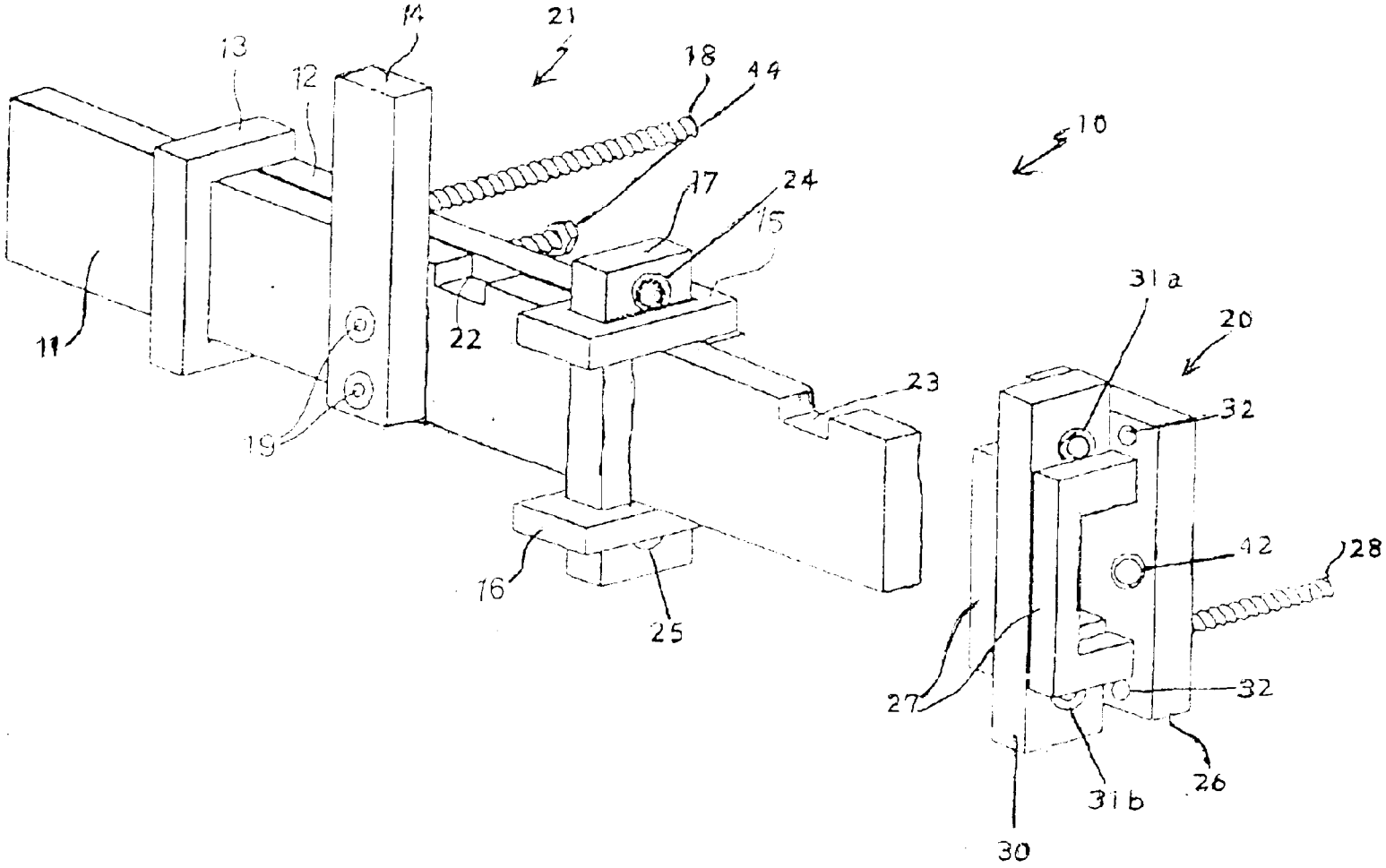
FIG. 1 of the drawings is a perspective view of a gate and door latch according to the present invention, showing the latch in an open position.

Referring to the drawings by numerals of reference, there is shown in FIG. 1 a gate and door latch 10, which includes a striker 11. The striker 11 lies adjacent to a security plate 12 behind the striker. The striker 11 and security plate 12 are preferably generally rectangular in vertical cross-section. To the security plate 12 is attached a striker bracket 13 through which the striker 11 slides. To the generally horizontally oriented striker 11 is attached a generally vertically oriented striker handle 14, which is attached by a handle attaching means 19 here shown as two screws. A third screw from the back side is not shown. The striker handle 14 allows for facile gripping by the user. The slidable striker 11 can be moved horizontally (left to right and vice versa) using the handle 14.

As shown in FIGS. 1 (perspective view), 2 (front view), and 3 (rear view), two notches are defined along the top edge of the striker 11. Of these, a first notch 22 is located adjacent to the striker handle 14 and a second notch 23 is located toward the striker's right, keeper bracket-engaging end. A locking member 17 drops in one or both of the notches 22, 23 to lock the latch 10 open all the way or close it all the way, or to catch the latch 10 when it is not locked to prevent the striker 11 from sliding. The locking member 17 may be in a locked up position, so that the locking member does not drop down in either one of the notches 22, 23. The striker 11 may be moved right or left all the way without being held in either notch.

Figure 2:
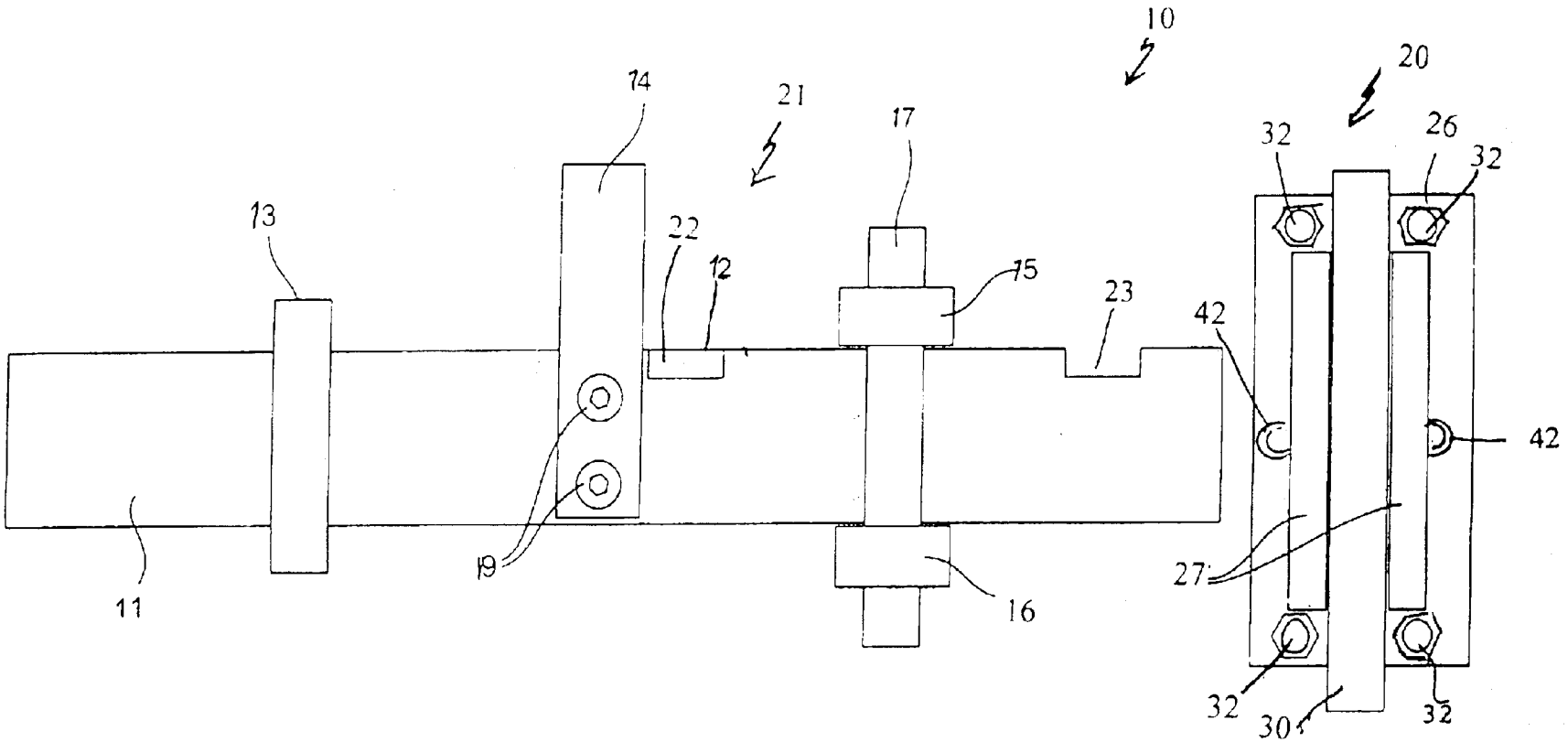
FIG. 2 of the drawings is a front elevation view of a gate and door latch according to the present invention, showing the latch in an open position.
Figure 3:
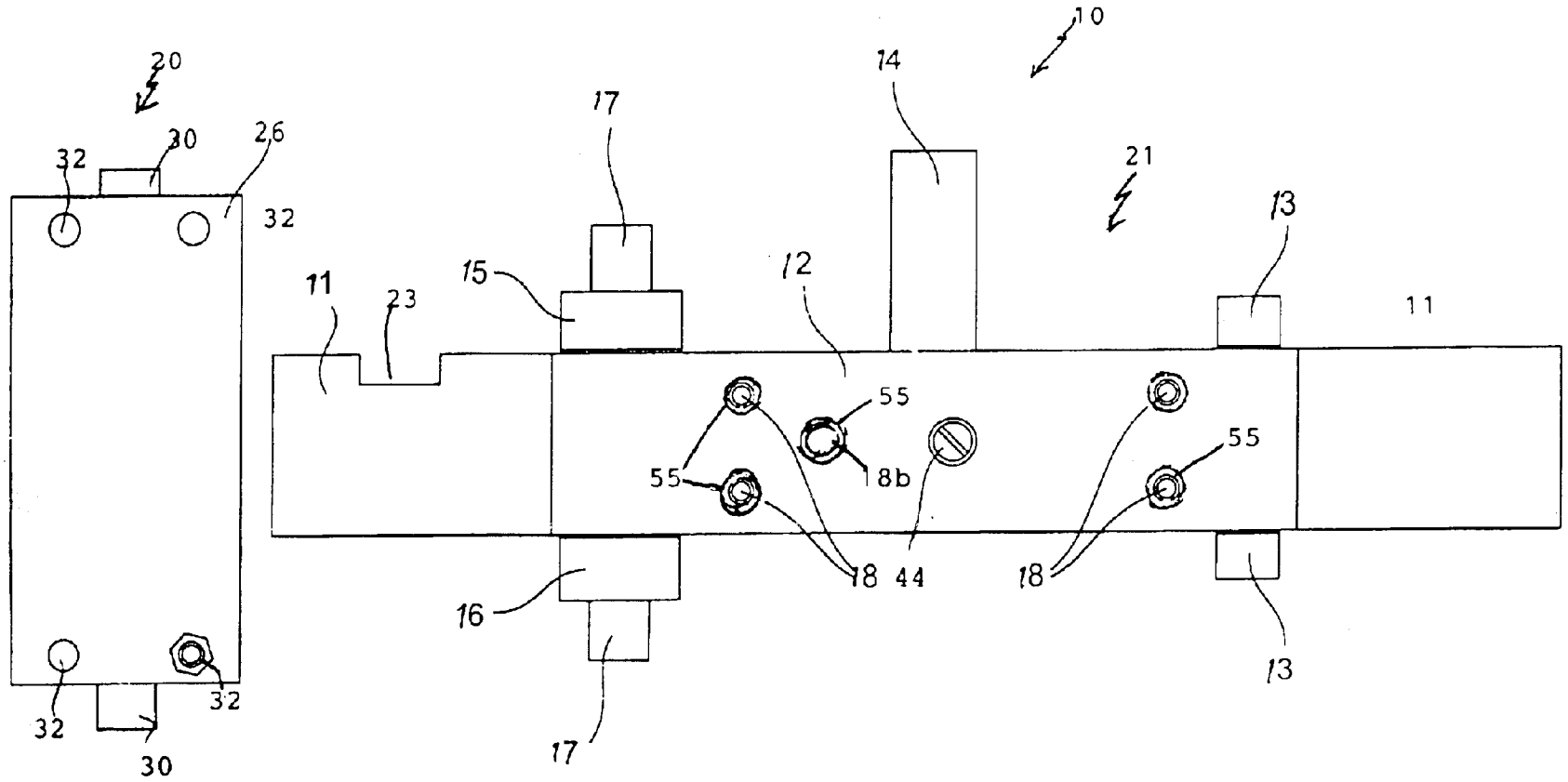
FIG. 3 of the drawings is a rear elevation view of the gate and door latch according to FIG. 2.

Continuing with FIGS. 1, 2, and 3, locking member 17 is slidably attached to the security plate 12 by an upper bracket 15 and a lower bracket 16. The upper and lower brackets 15, 16 prevent lateral movement of the slidable locking member. The striker bracket 13 is preferably welded onto the security plate 12, as are the upper and lower brackets 15, 16. The striker 11 is slidable through a channel in locking member 17. A portion of the locking member 17 is slidable into either of the notches for fastening the striker or preventing the striker from sliding.

The generally horizontally oriented security plate 12 is attached to a gate or door by a gate attaching means 18, here shown as screw bolts. To mount the latch on a gate or door, the security plate 12 is mounted onto the gate or door using a number of gate attaching bolts 18, 18*b*. The gate attaching bolts pass through holes defined in the security plate and through the door or gate. The bolt heads are sunk into the security plate. The striker handle 14 is then mounted on the striker 11.

As shown in FIG. 1, two circular locking member apertures 24, 25 are defined in the locking member 17 along a horizontal axis of the striker 11. These upper 24 and lower 25 locking member apertures extend generally parallel to one another, and oriented on a generally horizontal axis that is perpendicular to the longitudinal axis of the striker 11. When the locking member 17 is not engaged in a notch 22, 23, a semi-circular, movable arm of a conventional combination security lock (not shown) or padlock, or any rod or pin, may be inserted into the upper (or lower) locking member aperture 24 to prevent the locking member from dropping down, thus locking the locking member 17 open. This prevents the user from accidentally locking himself or herself in once he or she opens the gate or door and enters the paddock, room, etc. accessed by the door or gate. It is also helpful, for example, where the user is carrying something in one hand, or is disabled, and only has use of one hand. The rod in the locking member aperture holds the latch up so the gate can be moved with the one free hand. The locking member 17 can be locked in an up or down position by inserting a rod or the like through either the upper or lower locking member aperture 24, 25.

Figure 1A:
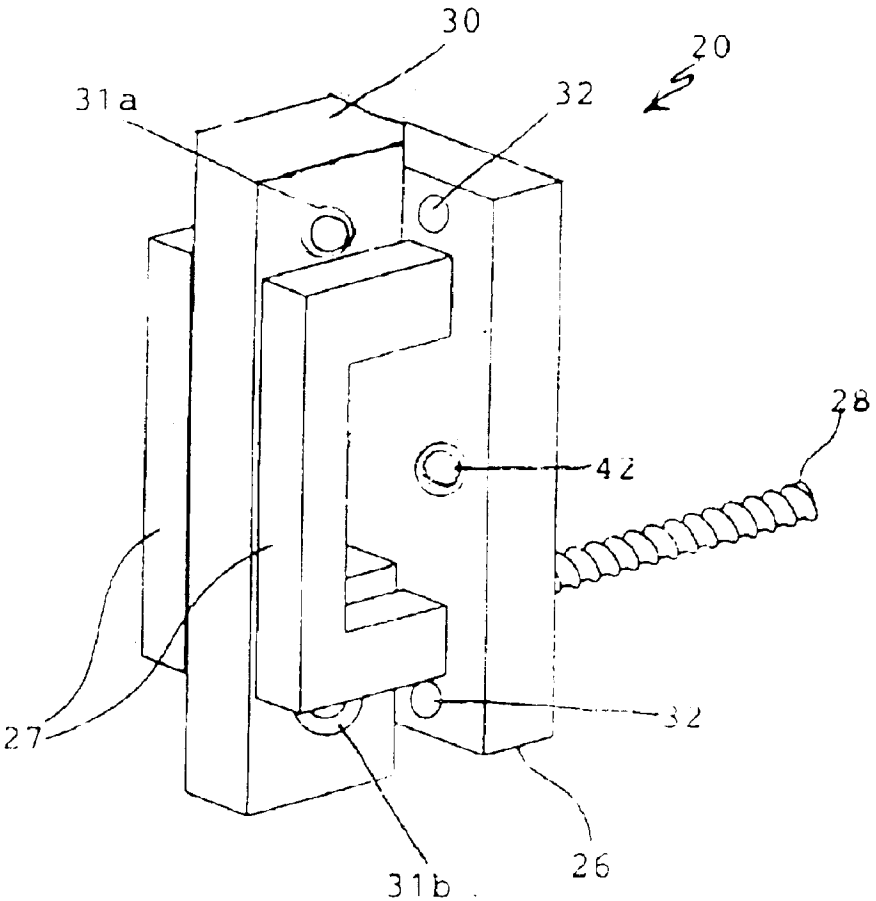
FIG. 1A of the drawings is a perspective view of a keeper unit according to the present invention.

Referring to FIGS. 1, 1A, 2, and 3, a separate keeper unit 20 comprises two C-brackets 27, a central keeper member 30, a keeper plate 26, and means 28 for securing the keeper plate to the gate or door 29. Each of the keeper C-brackets 27 is attached at each end of the "Cs" formed thereby to the keeper plate 26. The C-brackets 27 are adjacent to, but apart from, one another. To latch the gate or door, the user slides the striker 11 through the C-brackets. As shown in FIGS. 1 and 1A (keeper unit only), the preferred embodiment of the present invention includes a keeper unit 20 with a central keeper member 30 between the C-brackets 27. The central keeper member 30 is also C-shaped to allow the striker 11 to slide through. The movable central keeper member includes matching holes 31 in its upper (31*a*) and lower (31*b*) quadrants. The central keeper holes 31*a,b* extend in the same direction as the locking member apertures 24, 25, and are sized to receive an arm of a security lock or the like. A number of second bolt apertures 32 extend through the keeper plate 26 for receiving the gate attaching means. Hexagonal- (shown in FIG. 2) or pentagonal-shaped heads on the bolts that pass through the second bolt apertures 32 abut the ends of the keeper C-brackets 27 to substantially prevent the bolts from being turned out.

Each of these elements are shown in FIG. 2 and FIG. 3, except that: (1) because FIG. 2 is a front elevational view of the gate or door latch 10, it does not show a gate attaching mechanism 18 and only shows a small portion of the security plate 12; and (2) because FIG. 3 is a rear elevation, it does not show the C-bracket 27 and does not show handle attaching mechanism 19.

To latch the latch 10, the user grasps the striker handle 14 and pushes the striker 11 across into the C-brackets 27 of the keeper unit 20. The striker unit 21 is on one side of the gate or door and the keeper unit 20 is on the other side (see FIG. 4). The locking member 17 drops into second notch 23. When the latch 10 is opened, the striker 11 slides back and the locking member 17 drops into the first notch 22. There are two ways for a user to lock the latch 10 once it is in a closed position: place the arm of a combination lock, padlock, or locking pin through the lower locking member aperture 25 in the striker unit 21, or through the lower central keeper hole 31*b* in the keeper unit 20. For convenience, the user may store the combination lock or padlock (not shown) on the gate or door when the padlock or combination lock is not in use (when the latch is in an open position) by placing the arm of the combination lock or padlock through the upper locking member aperture, or the upper central keeper hole 31*a*. Then the latch may be open or closed without the locking member dropping in either notch. To lock the latch, the padlock or combination lock is removed and its arm is placed through lower central keeper hole 31*b*, and/or lower locking member aperture 25.

Figure 4:
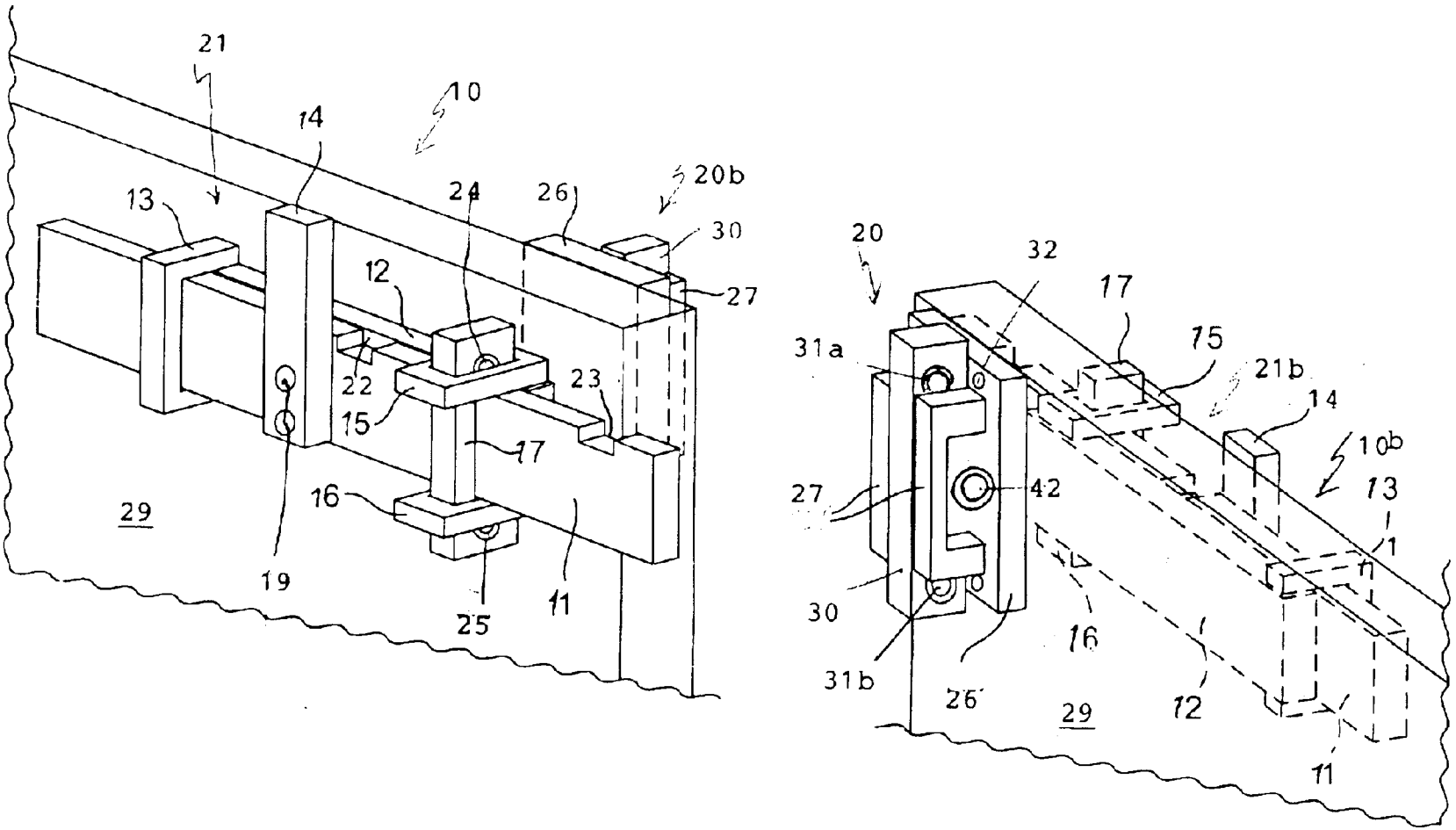
FIG. 4 of the drawings is a perspective view of two gate and door latches according to the present invention, shown in an open position.

FIG. 4 illustrates two gate and door latches 10, 10*b* in an open position on opposite faces of an open double door or gate 29. Each latch 10, 10*b* includes a striker unit 21 and a keeper unit 20 positioned on one side of the double gate or door. The gate or door is double; it has a first side and a second side. Thus, one striker unit 21 is attached to a front face of a first side of the double door or gate, and a keeper unit 20*b*, shown in dashed lines in FIG. 4, is correspondingly attached to a front face of a second side of the double door or gate. Further, a second keeper unit 20 is attached to a rear face of the first side of the double door or gate, and a second striker unit 21*b*, shown in dashed lines, is correspondingly attached to a rear face of the second side of the double door or gate, or vice versa. The gate and door latch is usable in both a left-hand and right-hand configuration. The double gate or door can be latched from inside or outside the door or gate. The latch of the present invention is suitable for use on a single hung or double hung door or gate.

It is advantageous to leave a slight space between a wooden door or gate and the security plate 12 so water will be less likely to collect behind the latch and cause the door or gate to rot. This is particularly true for outside gates and even for inside doors in geographic areas with high humidity. This is accomplished by fixing washers 55 on some or all of the gate attaching bolts between the rear of the security plate 12, as shown in FIG. 3, and the door or gate to which it is affixed.

Figure 5:
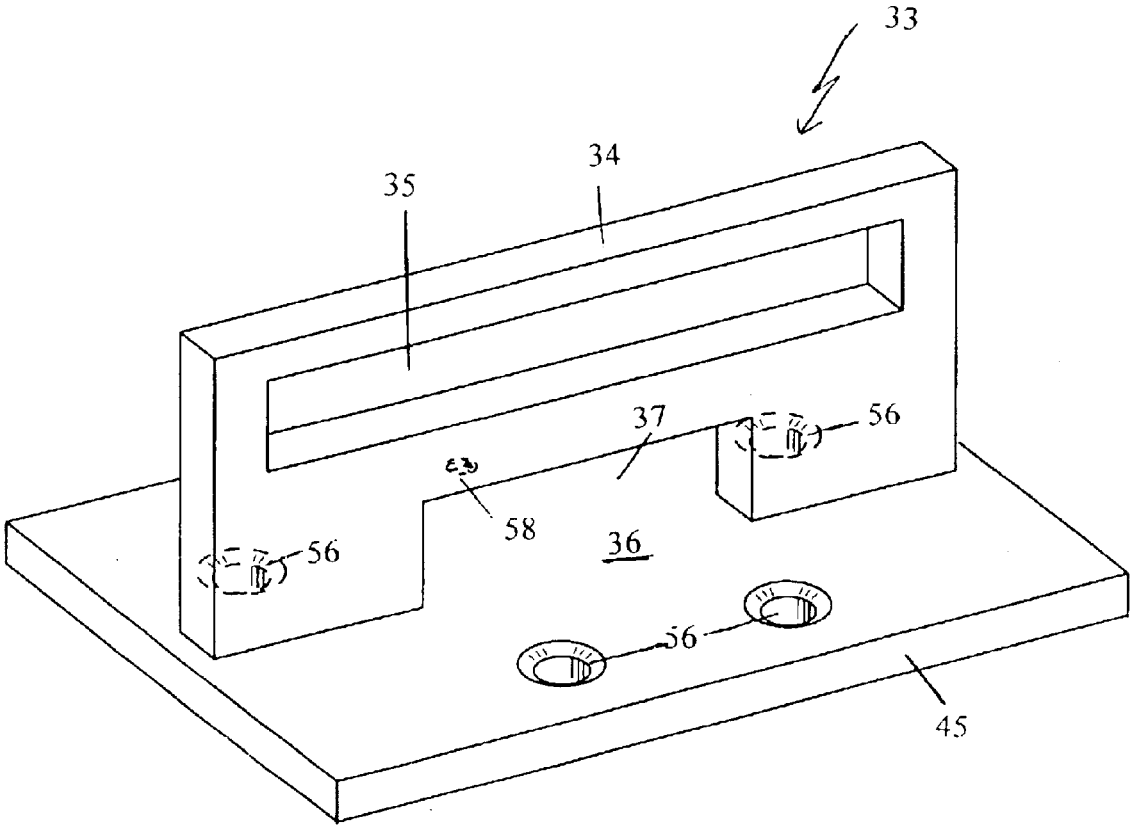
FIG. 5 of the drawings is a perspective view of a handle unit according to the present invention.

Referring to FIG. 5, a handle unit 33 can be placed adjacent to the left end of security plate 12. The handle unit 33 comprises a handle grip 34, and a substantially planar handle base 45. The handle grip 34 is attached at substantially a ninety degree angle to the front surface 36 of the handle base 45. A handle space 35 defined within the handle grip 34 is large enough to fit two or three of the user's fingers, so the user can insert his or her fingers through the handle space and pull the door open. The design of the handle unit prevents the user from butting his or her fingers against the striker bracket 13 (see FIG. 1). A striker space 37 within the handle unit 33 is defined by the generally "C"-shaped handle grip 34 and the outside front face 36 of the handle base 45, as shown in FIG. 5. The handle base 45 is preferably substantially wider than the handle grip 34, as shown in FIG. 5, to provide stability. The line of attachment between the handle grip 34 and the handle base 45 is preferably slightly off-center, as shown in FIG. 5, to leave room for security screw holes 56 in the handle base. A smaller screw hole 58 in the handle base 45 is for an inset screw (not shown). The handle unit 33 is particularly useful for preventing larger latches from being dismantled.

In the closed latch position, the striker 11 is engaged with the keeper unit 20. The outside latch 10 may be locked open and cannot be used to lock the gate or door when the user is inside the paddock, room, etc. accessed by the gate or door. Similarly, the inside latch 10*b* may be locked open and cannot be used when the user is outside the gate or door. Also the alternate handle unit 33 may be used to pull this section of the door open or closed when placed at the left end of security plate 12.

Continuing with FIG. 5, the handle unit 33 can also be used on a double door or gate in place of the keeper unit 20, if the "C" shaped handle grip 34 is attached to the handle base 45 rather than to a security plate 12. The striker 11 on the other side of the gate or door is slidable through the striker space 37 formed by the handle grip 34 and the front face of the handle base 45, which latches the door. In this embodiment, the handle grip 34 is usable for pushing or pulling the side of the door or gate 29 on which it is affixed. Also, this embodiment includes a second notch 23 in the striker 11, since the handle unit 33 does not include a central keeper member 30. Second notch 23 should stay in during use, since it is used to lock striker 11 all the way open.

Figure 3B:
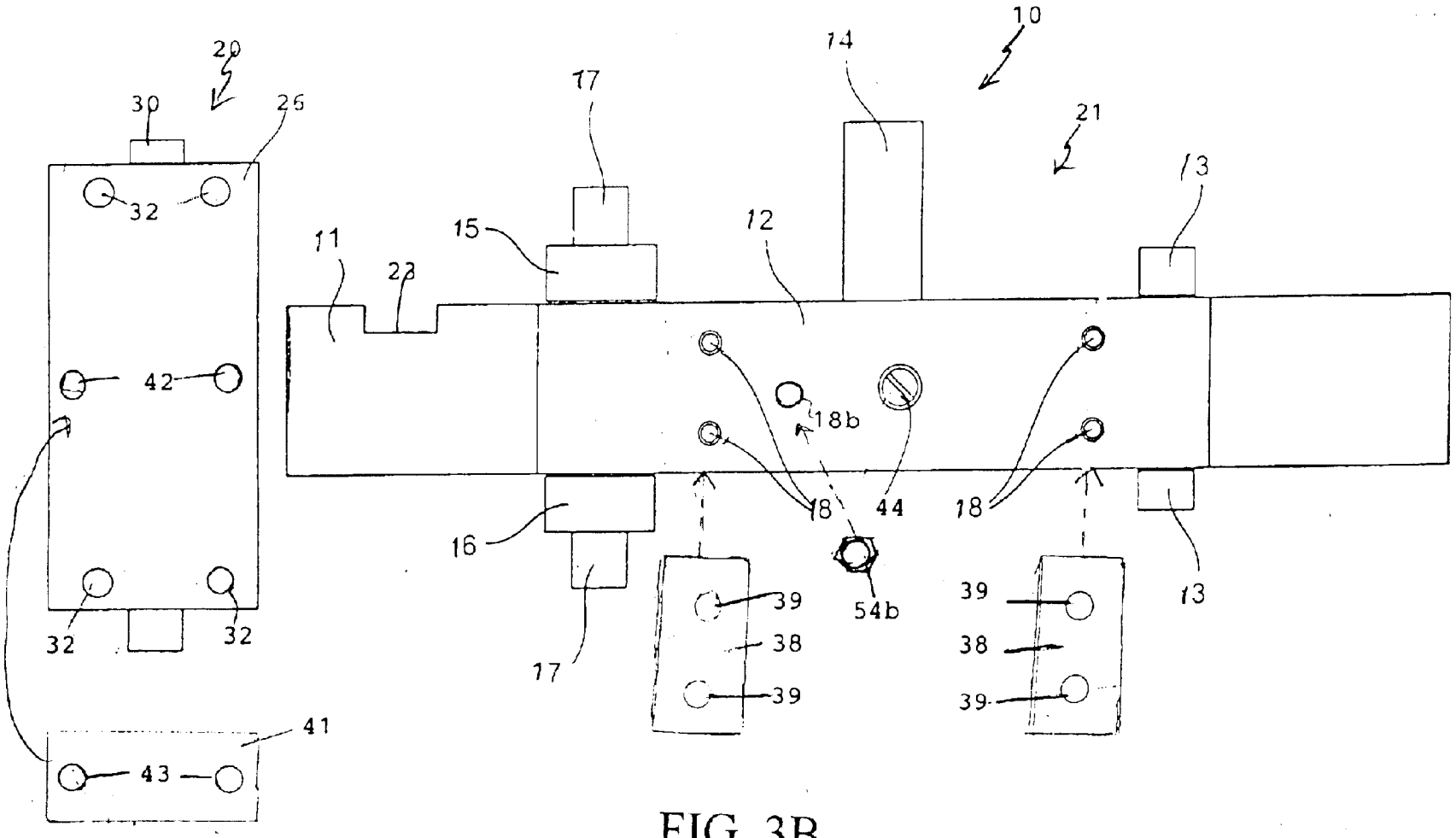
FIG. 3B of the drawings is a rear elevation view of the gate and door latch according to the present invention, showing the latch in an open position.

FIG. 3B illustrates an alternate embodiment of the latch 10. FIG. 3B shows a striker unit 21 with generally rectangular shaped matching double taps 38 for added security, particularly where the latch is on an outdoor gate. For the purpose of illustration, the taps 38 are shown below the striker unit 21 in FIG. 3B. Each generally vertically-oriented tap 38 includes two matching circular threaded holes 39, one hole being directly below the other. Each double tap 38 mounts on the opposite side of the gate or door. As indicated by the endmost dashed arrows in FIG. 3B, the two tap holes 39 are placed over corresponding gate attaching bolts 18 shown above them in FIG. 3B. As indicated by the middle dashed arrow in FIG. 3B, a nut 54*b* fits over the end of gate attaching bolt 18*b* where it protrudes through the opposite side of the gate or door.

Continuing with FIGS. 3B and 4, the keeper unit 20 mounts on the opposite gate or door in the set at the same height from the ground as the striker unit 21 (see FIG. 4). The keeper unit 20 comprises two generally circular-shaped, matching holes 42 in a central portion of the keeper plate 26 corresponding to the positions of two holes 43 in a third, horizontally-oriented tap 41 (see FIG. 3B). The tap holes 43 line up with the two recessed, second holes 42 in the keeper plate on the opposite side of the gate or door. Bolts are inserted through second bolt apertures 32 in the keeper unit 20. Screw bolts passing through each of the second keeper plate holes 42 (see FIG. 4) screw into the third tap 41 (see FIG. 3B) on the other side of the gate or door, when the latches are not mounted directly over one another on opposite sides of the gate or door. The heads of the screw bolts cannot be seen from the outside when the striker is closed. The taps 38, 41 make it difficult for a burglar to dismantle the latch 10. They also save time and labor by reducing the number of screws required to assemble the latch 10.

Continuing with FIGS. 3 and 3B, additional security is provided by striker screw 18*b*, which extends through the security plate 12, and the gate, and threads into a threaded tap hole through tap 54*b* (see FIG. 3B). The striker screw 44 is hidden by the striker 11. The striker cannot be removed when it is locked. The striker screw 44 optionally screws into the backside of handle 14 for added security. It fixes the handle so it cannot be removed by a potential thief. Even if a thief attempts to remove the striker handle 14 by detaching the handle attaching means 19 from the front of the striker unit 21, striker screw 44 is recessed into the back side of striker 11 and so remains hidden from view by the striker 11. The security plate and the door have apertures with a diameter large enough to closely accommodate the striker screw 44. Striker screw 44 is of a correct length to pass into a recessed hole in the back side of striker 11, and into handle 14.

Figure 6:
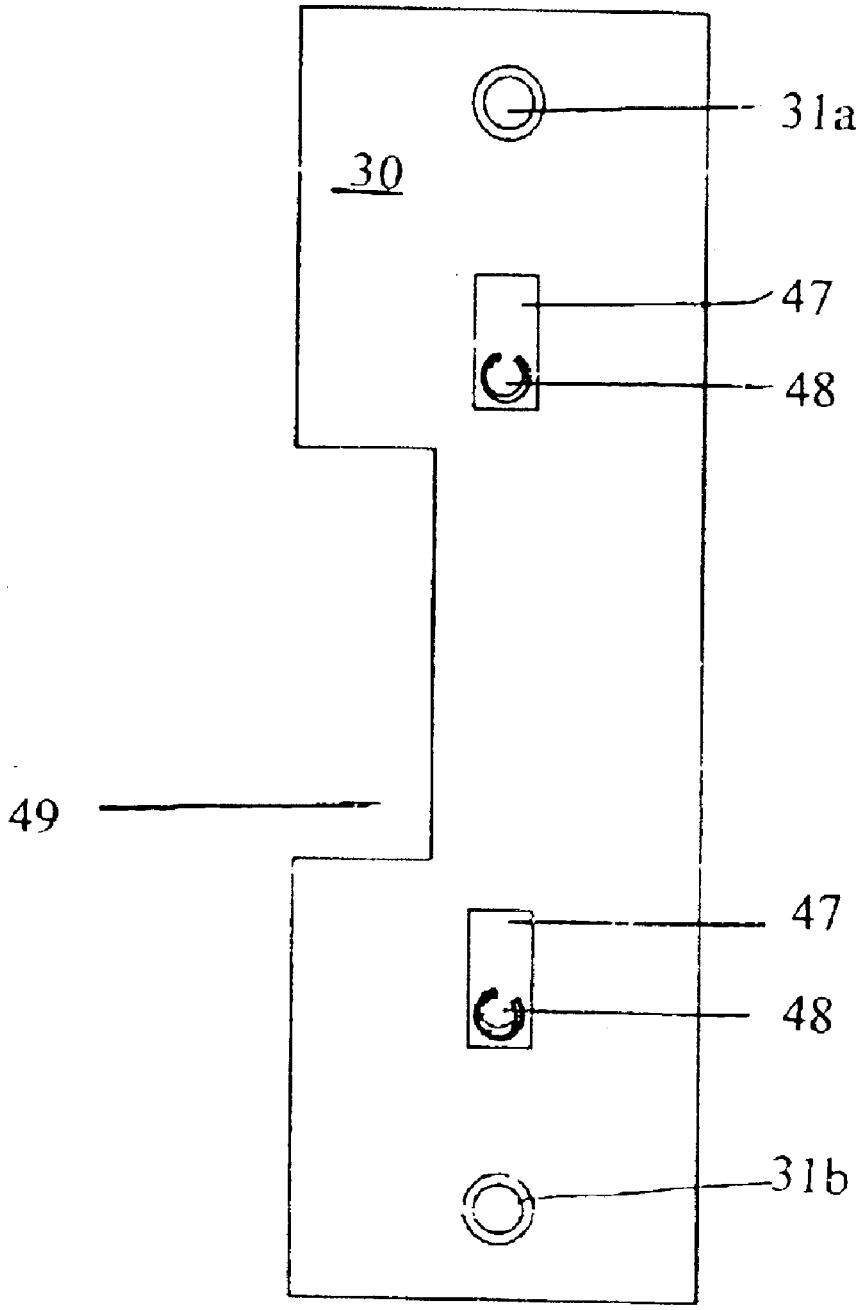
FIG. 6 of the drawings is a cross-sectional side view of a central keeper member of a gate and door latch according to the present invention.

Referring to FIG. 6, a central keeper member 30 comprises two generally rectangular-shaped matching slots 47 for receiving slender matching pins 48. The ends of the horizontally-oriented central keeper spring pins 48 fit into corresponding slots (not shown) in the sides of the vertically-oriented C-brackets 27 on either side of the generally vertically-oriented central keeper member 30. The pins 48 cannot be seen from the outside of the latch, so a potential thief would not be aware of their presence. The diameter of each central keeper spring pin 48 is less than the width of each central keeper slot 47, so the central keeper member 30 can be moved up slightly by pushing up the bottom of the central keeper member. The front portion of the striker 11 fits through central keeper groove 49 when it is in a closed position. When the central keeper member 30 is released, as also occurs when the striker 11 is removed from the groove 49, the central keeper member drops down by gravity into a position where the central keeper spring pins 48 are in the upper parts of the central keeper slots 47 and the lower central keeper hole 31*b* is exposed. An arm of a lock can then be placed through the central keeper hole 31*b* to lock the central keeper member in position.

Figure 7:
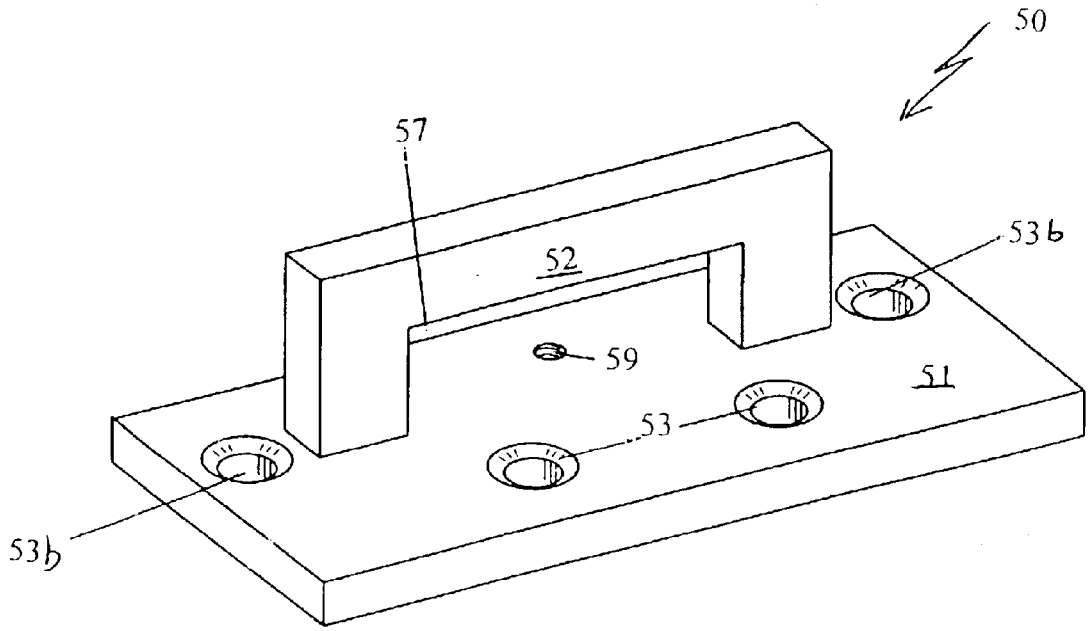
FIG. 7 of the drawings is a perspective view of an alternate embodiment of a keeper unit of a gate and door latch according to the present invention.

Referring to FIG. 7, an alternate embodiment of a keeper unit 50 for a gate and door latch includes a keeper plate 51 and a keeper C-bracket 52. The opposite ends of the keeper C-bracket 52 are attached to the keeper plate 51, forming an approximately ninety degree angle between the keeper C-bracket and the keeper plate. A generally rectangular-shaped space 57 between the keeper C-bracket 52 and the keeper plate 51 accommodates a portion of the striker 11. This embodiment is well-suited for use on single hung doors.

As shown in FIG. 7, the keeper plate 51 includes two same-sized keeper screw holes 53 along one side of the keeper plate to the left or right of the keeper C-bracket. The keeper screw holes 53 are in a central area of the keeper plate that is crossed over by the striker 11 when the striker is closed. Thus, the striker 11 conceals the keeper screw holes 53, and the bolt heads in them, when the striker is closed. This makes it more difficult for a thief to break in. A smaller diameter inset screw hole 59 at the approximate center of an opposite side of the keeper plate 45 accommodates an inset screw (not shown). Two additional matching keeper screw holes 53*b* are positioned at opposite ends of the keeper plate adjacent to the ends of the keeper C-bracket, although fewer than four keeper screw holes would also be suitable. The gate attaching means preferably includes screws or bolts (not shown), which are inserted through the keeper screw holes 53, 53*b* to attach the keeper unit 50 to the gate or door jamb.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 gate and door latch
11 striker
12 security plate
13 striker bracket
14 striker handle
15 upper bracket
16 lower bracket
17 locking member
18, 18*b* gate attaching means
19 handle attaching means
20 keeper unit
21 striker unit
22 first notch
23 second notch
24 upper locking member aperture
25 lower locking member aperture
26 keeper plate
27 C-bracket
28 keeper attachment means
29 gate or door
30 central keeper member
31 central keeper holes
32 bolt apertures
33 handle unit
34 handle grip
35 handle space
36 front face of handle base
37 striker space
38 double tap
39 threaded holes in double taps
40 first threaded holes in keeper plate
41 third tap
42 second holes in keeper plate
43 threaded holes in third tap
44 striker screw
45 handle base
47 central keeper slot
48 central keeper spring pin
49 central keeper groove
50 keeper unit- alternate embodiment
51 keeper plate- alternate embodiment
52 keeper C-bracket- alternate embodiment
53 keeper holes- alternate embodiment
54 nut on gate attaching bolt
55 washer on gate attaching bolt
56 handle security screw holes
57 keeper space
58 inset screw hole in handle base
59 inset screw hole in keeper plate

What is claimed is:

1. A reversible security latch for a double gate or door, comprising:

a. a striker unit for a attachment to a first side of a gate or door, comprising:
   1) a striker comprising at least two notches in a top portion of the striker, a first one of the notches being proximate to a horizontal center of the striker, a second one of the notches being proximate to an end of the striker;
   2) a security plate, which lies adjacent to the striker;
   3) a striker bracket attached to the security plate and through which the striker slides; and
   4) a locking member slidably attached to the security plate, the striker being slidable through the locking member, a portion of the locking member being slidable into at least one of the notches for fastening the striker or preventing the striker from sliding;

b. a separate keeper unit for attachment to an opposite second, side of the gate or door, comprising:
   1) at least one C-bracket for receiving the striker, and
   2) a keeper plate, the at least one C-bracket being attached to the keeper plate; and c. a gate attaching means for securing the security plate of the striker unit and the keeper plate of the keeper unit to the respective side of the double gate or door;

wherein a movable central keeper member is slidably mounted between two of the keeper C-brackets.

2. A gate and door latch according to claim 1, wherein the striker unit further comprises an upper bracket and a lower bracket attaching the locking member to the security plate, the striker and the security plate being generally rectangular in their vertical cross-sections.

3. A gate and door latch according to claim 1, wherein the central keeper member comprises at least one central keeper slot, a central keeper spring pin movably passing partially therethrough, opposite ends of the central keeper spring pin being supported by the C-brackets on either side of the central keeper member.

4. A gate and door latch according to claim 2, further comprising a plurality of screws attaching the striker handle to the striker, one of the plurality of screws being a striker screw for additional security, the striker screw extending through the gate or door, the security plate, and the striker, and partially into the handle.

5. A gate and door latch according to claim 1, wherein the striker and security plate are generally rectangular in vertical cross-section; the locking member being generally perpendicular to the striker.

6. A gate and door latch according to claim 1, wherein upper and lower locking member apertures are defined in the locking member, the two locking member apertures being oriented on a generally horizontal axis.

7. A gate and door latch according to claim 1, wherein a plurality of gate attaching bolts extending through the security plate are generally perpendicular to the security plate, the heads of the gate attaching bolts being hidden from a front view by the striker.

8. A gate and door latch according to claim 1, further comprising a second striker handle, which comprises a striker bracket, a handle grip that fits over the striker bracket, and a space behind the handle grip for receiving one or more fingers, the handle space being defined by the handle grip and a front face of the striker bracket, the striker bracket defining a striker space for the striker to slide through.

9. A gate and door latch according to claim 1, further comprising at least one tap mountable on a back side of the gate or door, the tap comprising a set of matching threaded holes corresponding to a like number of threaded screws passing through the threaded holes.

10. A gate and door latch according to claim 9, wherein one striker unit is attached to a front face of a first side of a double door or gate, and a keeper unit is correspondingly attached to a front face of a second side of the double door or gate; a second keeper unit being attached to a rear face of the first side of the double door or gate, a second striker unit being correspondingly attached to a rear face of the second side of the double door or gate.

11. A gate and door latch according to claim 10, further comprising two double taps affixed to a back side of the door or gate, the double taps comprising generally circular-shaped, matching threaded tap holes, each of the threaded tap holes corresponding to a second threaded hole in a central portion of the striker unit on the opposite face of the same side of the gate or door; wherein a threaded screw bolt passes through one of the second threaded holes in the striker unit, through the gate or door, and into one of the threaded tap holes.

12. A gate and door latch according to claim 11, further comprising a third tap abutting the back side of the gate or door, the third tap comprising two threaded holes corresponding to two sinker holes in a central portion of the keeper plate; the generally rectangular-shaped third tap having the same size and shape as the two double taps, but with a longitudinal axis that is generally horizontal in comparison to a generally vertical longitudinal axis of the double taps.

13. A gate and door latch according to claim 1, wherein a pentagonal- or hexagonal-shaped head of each of the gate attaching bolts in the bolt holes abuts an end of one of the keeper C-brackets to substantially prevent the gate attaching bolts from being turned out.

14. A reversible, security latch for a double gate or door, comprising:

a. a striker unit for attachment to a first side of the gate or door, comprising:
   1) a striker comprising at least two notches defined in a top of the striker, a first one of the two notches being proximate to a horizontal center of the striker, a second one of the two notches being proximate to a right end of the striker when viewed from the front;
   2) a security plate, which lies adjacent to the striker;
   3) a striker bracket attached to the security plate and through which the striker slides;
   4) a locking member slidably attached to the security plate through which the striker slides; and
   5) an upper bracket and a lower bracket attaching the locking member to the security plate;

b. a separate handle unit for attachment to a side of the gate or door, comprising: a handle grip and a substantially planar handle base, the handle grip being attached at substantially a ninety degree angle to a front surface of the handle base, a handle space being defined within the handle grip, the handle grip and the handle base defining a striker space, the striker being slidable through the striker space; and c. a gate attaching means for securing the security plate of the striker unit and the handle base to a side of the double gate or door.

15. A gate and door latch according to claim 14, further comprising a striker handle attached to the striker adjacent to the first notch.

16. A security latch for a single hung gate or door, the latch comprising:

a. a striker unit for attachment to the gate or door, comprising:
   1) a striker comprising at least two notches in a top portion of the striker, a first one of the two notches being proximate to a horizontal center of the striker, a second one of the two notches being proximate to a right end of the striker when viewed from the front;
   2) a security plate, which lies adjacent to the striker;
   3) a striker bracket attached to the security plate and through which the striker slides;
   4) a locking member slidably attached to the security plate through which the striker slides; and
   5) an upper bracket and a lower bracket movably attaching the locking member to the security plate;

b. a separate keeper unit, comprising:
   1) a keeper plate for attachment to the door or gate,
   2) a C-bracket attached at its opposite ends to the keeper plate, substantially forming a right angle between the keeper C-bracket and the keeper plate; the keeper C-bracket and the keeper plate defining a space for accommodating the striker; wherein the keeper plate further comprises at least one keeper screw hole in a central area of the keeper plate to one side of the longitudinal center line; and c. gate attaching means for securing the keeper unit, and the security plate of the striker unit and the handle base, to the gate or door.

17. A gate and door latch according to claim 16, further comprising a striker handle attached to the striker adjacent to the first notch.

* * * * *